US009289037B2

(12) United States Patent
Yansheng et al.

(10) Patent No.: US 9,289,037 B2
(45) Date of Patent: Mar. 22, 2016

(54) HARDENED COBALT BASED ALLOY JEWELRY AND RELATED METHODS

(71) Applicant: Matrix Metals LLC, Ogden, UT (US)

(72) Inventors: Zhou Yansheng, Beijing (CN); Liu Jianjun, Beijing (CN)

(73) Assignee: MYTHRIAL METALS LLC, Ogden, UT (US)

( * ) Notice: Subject to any disclaimer, the term of this patent is extended or adjusted under 35 U.S.C. 154(b) by 0 days.

(21) Appl. No.: 13/657,336

(22) Filed: Oct. 22, 2012

(65) Prior Publication Data

US 2013/0098108 A1 Apr. 25, 2013

Related U.S. Application Data

(60) Provisional application No. 61/549,341, filed on Oct. 20, 2011.

(51) Int. Cl.

| | |
|---|---|
| ***A44C 9/00*** | (2006.01) |
| ***A44C 27/00*** | (2006.01) |
| ***B22D 25/02*** | (2006.01) |

(52) U.S. Cl.

CPC ..... *A44C 9/00* (2013.01); *A44C 27/003* (2013.01); *B22D 25/026* (2013.01)

(58) Field of Classification Search

CPC ..... A44C 27/003; A44C 9/00; B22D 25/026
USPC ..... 148/425
See application file for complete search history.

(56) References Cited

U.S. PATENT DOCUMENTS

| | | | | |
|---|---|---|---|---|
| 2,033,814 | A * | 3/1936 | Brown | 251/359 |
| 3,635,703 | A * | 1/1972 | Pissarevsky | 420/436 |
| 4,353,742 | A | 10/1982 | Crook | |
| 4,668,290 | A | 5/1987 | Wang et al. | |
| 4,824,123 | A * | 4/1989 | Chia et al. | 277/382 |
| 6,062,045 | A | 5/2000 | West | |
| 6,553,667 | B1 | 4/2003 | West | |
| 6,733,603 | B1 | 5/2004 | Wu et al. | |
| 6,852,176 | B2 | 2/2005 | Wu et al. | |
| 6,928,734 | B1 | 8/2005 | West | |
| 6,990,736 | B2 | 1/2006 | West | |
| 6,993,842 | B2 | 2/2006 | West | |
| 7,032,314 | B2 | 4/2006 | West | |
| 7,076,972 | B2 | 7/2006 | West | |
| 8,603,264 | B2 | 12/2013 | Wu et al. | |
| 8,956,510 | B2 | 2/2015 | Derrig | |
| 2006/0210826 | A1 | 9/2006 | Wu et al. | |
| 2010/0329920 | A1* | 12/2010 | Rosenberg | A44C 27/003 420/440 |
| 2014/0057122 | A1 | 2/2014 | Wu et al. | |

FOREIGN PATENT DOCUMENTS

| | | | |
|---|---|---|---|
| CA | 2314565 | C | 6/2007 |
| CN | 86108289 | A | 8/1987 |
| CN | 103060617 | A | 4/2013 |
| EP | 20040814903 | A4 | 6/2009 |
| JP | S61179838 | A | 8/1986 |
| JP | S62136544 | A | 6/1987 |
| JP | H02236239 | A | 9/1990 |

OTHER PUBLICATIONS

Rolled Alloys, "Tribaloy T-800 Alloy Data Sheer", No Date.*

Hoover & Strong, Ring Blanks, retrieved from https://www.hooverandstrong.com/ring-blanks, on Sep. 11, 2015, 4 pages.

Find Your Ring Size Guide, How to Determine Your Ring Size, Blue Nile Inc., 2015, 9 pages.

Alloy Database—Composition—Deloro Stellite Group. Kennametal Stellite. "Stellite 703." Web. Jan. 20, 2015. <http://www.stellite.com/alloydatabase/nominal.asp?b=Cobalt>.

Kuzucu, V. "The Effect of Strong Carbide-forming Elements Such as Mo, Ti. V and Nb on the Microstructure of Ferritic Stainless Steel." Journal of Materials Processing Technology 82 (1998): 165-71. <http://www.sciencedirect.com/science/article/pii/S0924013698000284>.

Deloro Stellite Company, Inc. A New Stellite Alloy Series That Resists Wear and Corrosion. N.p.: Deloro Stellite, Stellite®-700 Alloys. No. 2050 <http://www.stellite.com/Portals/0/Stellite700,pdf.pdf>.

Davenport, A. T., and R.W. K. Honeycombe. "Precipitation of Carbides at γ-α Boundaries in Alloy Steels." Proceedings of the Royal Society of London A 322 (1971): 191-205. Proceedings A. The Royal Society Publishing. Web. Jan. 20, 2015. <http://rspa.royalsocietypublishing.org/content/royprsa/322/1549/191.full.pdf>.

"Failure of Intermetallics Investigated Using World's Most Powerful Electron Microscope." AZO Materials (Feb. 2, 2005): <http://www.azom.com/article?aspx?ArticleID=2744>.

Kim, Chang Kyu, et al. "Effects of Alloying Elements on Microstructure, Hardness,." Metallurgical and Material Transactions A 36A (Jan. 2005): 87-97. <http://link.springer.com/article/10.1007%2Fs11661-005-0141-0>.

Hwang, Keun Chul. "Effects of Alloying Elements on Microstructure and Fracture Properties of Cast High Speed Steel Rolls Part I: Microstructural Analysis." Materials Science and Engineering A254 (1998): 282-95. <http://www.sciencedirect.com/science/article/pii/S0921509398006261>.

(Continued)

*Primary Examiner* — Abigail Morrell

(57) ABSTRACT

Hardened cobalt alloys for forming jewelry, including finger rings as well as methods and processes for producing such alloys. In one illustrative embodiment, such an alloy can contain cobalt in an amount of from about 35 wt % to about 65 wt %, in combination with chromium in an amount of from about 16% wt to about 32 wt %, and molybdenum in an amount of from about 8 wt % to about 31 wt %. Aluminum, silicon, boron, titanium, and other hardness enhancing materials may also be present. Hot investment casting may be used to form items from the alloys, which may then be shaped or polished to a final form. Annular finger rings constructed from these materials may have a white appearance similar to white gold or platinum, may have increased resistance to scratching compared to traditional cobalt chromium rings, and may be easily be removed by cracking in an emergency situation.

36 Claims, No Drawings

(56) References Cited

OTHER PUBLICATIONS

"Cobalt—Based Carbide—Hardened Alloys—Nature and Properties." AZO Materials (Sep. 13, 2001): <http://www.azom.com/article.aspx?ArticleID=864>.

Cobalt Facts No. 4. Cobalt Developement Institute, 2006. Web. <http://www.thecdi.com/cdi/images/documents/facts/COBALT_FACTS-Metallurgical_%20uses.pdf>.

Podrez-Radziszewska, M., et al. "Characteristic of Intermetallic Phases in Cast Dental CoCrMo Alloy." Archives of Foundry Engineering 10.3 (2010): 51-56. Print.

Wu, James B. C., and Matthew X. Yao. "Wear and Corrosion-Resistant Alloys in the Oil and Gas Industry." Valve Magazine 18.3 (Summer 2006): 22-27. Stellite.com. Kennamental—Stellite. Web. <http://stellite.com/Portals/0/Valve%20Magzine.pdf>.

* cited by examiner

HARDENED COBALT BASED ALLOY JEWELRY AND RELATED METHODS

CROSS-REFERENCE TO RELATED APPLICATION

This application claims the benefit of U.S. Provisional Application No. 61/549,341, filed Oct. 20, 2011, the disclosure of which is incorporated herein by reference in its entirety.

TECHNICAL FIELD

The present disclosure generally relates to materials science and to jewelry, and more particularly to the use of hardened cobalt based materials for the creation of jewelry including finger rings.

BACKGROUND

Jewelry trends vary over time and jewelry makers have continually been looking for new materials and designs to enhance their products. Finger rings constructed from known cobalt chromium alloys have recently gained popularity in the industry, which may be due to their white colored appearance and strong nature. Typically such rings are constructed from alloys in accordance with ASTM standard 15-37 and have a Rockwell hardness in the range of HRC 17 to HRC 39. However, while these known rings are very strong and are not likely to chip or crack when a force is applied to it, when compared to other materials used on the market, the cobalt chromium alloys from which they are constructed are considered a "soft" material and are easily susceptible to scratching in everyday wear. Further, these rings can present a safety hazard as their removal in an emergency situation often requires the use of specialized motorized ring saw with an abrasive (diamond) cutting blade and an increased time in cutting through the hard material in comparison to a gold or platinum ring which may be removed using a common hand cranked ring saw of steel construction.

By contrast, another popular material for finger rings, tungsten carbide, has a very high resistance to scratching due to its hard exterior nature. However, tungsten carbide rings are susceptible to shattering or chipping when dropped due to its brittle nature. Also, tungsten carbide has a dark grey appearance which does not resemble any type of intrinsically valuable metal, such as gold silver or platinum. Further, tungsten carbide can oxidize over time due to a higher amount of nickel acting as a binder, altering its appearance. Such rings may also absorb oils from skin or lotions or other materials with which they come into contact, thus contributing to oxidization.

Accordingly, materials that can be used to create aesthetically pleasing jewelry, including finger rings, that have a desirable appearance but address the shortcomings of known cobalt chromium or tungsten carbide jewelry would be an improvement in the art, as would methods for constructing such jewelry.

SUMMARY

The present disclosure includes hardened cobalt alloys for forming jewelry, including finger rings as well as methods and processes for producing such alloys. In one illustrative embodiment, such an alloy can contain cobalt in an amount of from about 35 wt % to about 65 wt %, in combination with chromium in an amount of from about 16% wt to about 32 wt %, and molybdenum in an amount of from about 8 wt % to about 31 wt %. Aluminum, silicon, boron, titanium, and other hardness enhancing materials may also be present. Hot investment casting may be used to form items from the alloys, which may then be shaped or polished to a final form for use. Annular finger rings constructed from these materials may have a white appearance similar to white gold or platinum, may have increased resistance to scratching compared to traditional cobalt chromium rings, and may be easily be removed by cracking in an emergency situation.

DETAILED DESCRIPTION

Before the present method is disclosed and/or described, it is to be understood that the terminology used herein is for the purpose of describing particular embodiments and is not intended to be limiting.

As used herein and in the appended claims, the singular forms "a", "an", and "the" include plural reference unless the context clearly dictates otherwise.

"Optional" or "optionally" means that the subsequently described event or circumstance may or may not occur, and that the description includes instances where said event or circumstance occurs and instances where it does not.

The term "suitable" as used herein refers to a group that is compatible with the compounds, products, or compositions as provided herein for the stated purpose. Suitability for the stated purpose may be determined by one of ordinary skill in the art using only routine experimentation.

Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to" the value, "greater than or equal to the value" and possible ranges between values are also disclosed, as appropriately understood by the skilled artisan. For example, if the value "10" is disclosed the "less than or equal to 10" as well as "greater than or equal to 10" is also disclosed. It is also understood that throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

As used herein, a plurality of items, structural elements, compositional elements, and/or materials may be presented in a common list for convenience. However, these lists should be construed as though each member of the list is individually identified as a separate and unique member.

Any steps recited in any method or process claims may be executed in any order and are not limited to the order presented in the claims unless otherwise stated. Accordingly, the scope of any claimed invention should be determined solely by the appended claims and their legal equivalents, rather than by the descriptions and examples given herein.

Improvements to the state of the art can be made by finger rings composed of new hardened cobalt based alloys. Such finger rings may be formed as an annular ring having an inner surface which may be placed around the finger on which the ring is worn, and an outer surface that may include decoration. Such a finger ring may be formed from a composition including cobalt, secondary metals chromium and molybdenum, hardness enhancing metals, and a mixture of elements.

Traditional cobalt chromium material used in jewelry, including finger rings generally achieves a Rockwell's Hardness scale C (HRC) rating of 25 to 39. Although the traditional composition can vary somewhat, the cobalt may be present from about 65 wt % to 67 wt %, with the secondary metal chromium present from about 27 wt % to 29 wt %, and molybdenum may be present from about 5 wt % to 7 wt %, and other trace elements, usually silicon, may be present. These finger rings may be easily scratched during everyday wear as they are a relatively soft material. By contrast, finger rings made using the materials and methods of the present disclosure achieve a Rockwell's Hardness scale C (HRC) rating of 50 to 70 using hardened cobalt chromium alloys that contain a new mixture of materials.

Typically, cobalt, together with the secondary metals chromium and molybdenum together with a hardness enhancing mixture comprise the bulk of the compositions in accordance with the present disclosure, e.g. greater than about 90 wt %. Each component of the composition can provide different material properties to the finger ring and can affect properties such as density, hardness, fracture strength, scratch resistance, color uniformity, hardness, and the like. In accordance with one aspect of the present disclosure, the secondary metals chromium and molybdenum can be refractory metals.

The hardness enhancing mixture can be any suitable metal included in the alloy that increases the hardness of a finished product, such as a finger ring. Non-limiting examples of suitable metals can include aluminum, silicon, boron, titanium, iron, nickel, zirconium, cerium, lanthanum, carbon and manganese, other elements, and combinations thereof. In some illustrative embodiments, the hardness enhancing metals may be aluminum, titanium, boron and/or silicon. The hardness enhancing metals can be present in any functional amount; however, about 0.5 wt % to 10 wt % has shown good results. In some mixtures, iron may be used with a quantity of up to, but not more than about 6 wt %. In most embodiments, carbon, nickel and manganese may be used with quantities of up to, but not more than 3 wt % of each element. Furthermore, zirconium, yttrium, cerium and lanthanum may be used in most compositions with quantities of up to, but not more than about 0.5 wt % of each element.

In some embodiments of alloys in accordance with the present disclosure, cobalt may be present from about 35 wt % to about 65 wt %, chromium may be present from about 16 wt % to about 32 wt %, and molybdenum may be present from about 8 wt % to about 31 wt %. In one illustrative embodiment, the cobalt may be present from about 43 wt % to about 50 wt %, the chromium may be present from about 27 wt % to about 32 wt %, and the molybdenum may be present from about 12 wt % to about 16 wt %. In another illustrative embodiment, the cobalt may be present from about 43 wt % to about 50 wt %, and the molybdenum may be present from about 26 wt % to about 31 wt %, while the chromium may be present from about 16 wt % to 20 wt %. In still another illustrative embodiment, the cobalt may be present from about 58 wt % to about 66 wt %, the chromium may be present from about 17 wt % to about 21 wt %, and the molybdenum may be present from about 8 wt % to 12 wt %.

In one specific illustrative embodiment, the composition may be about 48 wt % cobalt, about 29 wt % chromium, about 14 wt % molybdenum, about 7 wt % of aluminum, about 1 wt % silicon, and from about 0.15 wt % to about 1.0 wt % titanium. In another specific illustrative embodiment, the composition may be about 48 wt % cobalt, about 28 wt % molybdenum, about 18 wt % chromium, about 3 wt % of silicon, about 2 wt % aluminum, and about 1 wt % titanium. In yet another specific illustrative embodiment, the composition may be about 65 wt % cobalt, about 19 wt % chromium, about 10 wt % molybdenum, about 3 wt % of silicon, 3 about wt % boron, and about 1 wt % titanium. This last illustrative embodiment allows for further inflation of the hardness and scratch resistance when compared to traditional cobalt chromium rings and jewelry.

One benefit of finger rings constructed from alloys in accordance with the present disclosure is that the surface may remain substantially free of discoloration from contact with skin for the duration of the life of the ring, due to its low percentage of nickel, reducing the tendency to absorb oils from skin and lotions. Furthermore, the density of finger rings constructed from alloys in accordance with the present disclosure is substantially lower than conventional tungsten carbide rings. In one aspect, the density of such a finger ring can be from about 4 $g/cm^3$ to about 11 $g/cm^3$, and in some embodiments about 7.5-9.5 $g/cm^3$. Although properties can vary, the finger rings can have an HRC of 50 to about 70, and in some embodiments can be greater than about 56, and often about 60.

Due to this increased hardness, finger rings of the present invention are substantially scratch proof under normal conditions of use. Such finger rings are also substantially less brittle than conventional tungsten carbide rings which can easily shatter when dropped on a hard surface. The presence of the ductility enhancing metals in the alloys acts to mitigate the extreme hardness provided by each of the cobalt, chromium and molybdenum by increasing strength. Also, rings made from the disclosed compositions are substantially lighter in weight when compared to tungsten carbide thus further reducing the likelihood of fracture upon impact from dropping the object on a hard surface.

Various items, included jewelry and finger rings may be made from the hardened cobalt based alloys of this disclosure by forming a particulate powder blend of cobalt, the secondary metals chromium and molybdenum, one or more of the hardness enhancing metals, aluminum, titanium, boron and silicon, and a combination of other binders such as iron, carbon, nickel, or manganese. The powders may be any suitable size such as from about 0.01 um to about 100 um, and sometimes from about 0.02 um to about 50 um, although other size ranges may be suitable for particular applications.

The particulate powder blend or mixture may then be processed by one of multiple different techniques. One illustrative technique is the process of hot investment casting. In a general sense, such a casting process may use the following steps: First, machining a master mould for forming a wax pattern; second, forming a wax pattern in the master mould; third, assembling a running system which may include assembling individual wax patterns to form a tree; fourth, painting or blasting grit on the wax pattern to shape a shell with sufficient thickness; fifth, removing the wax pattern by melting as by steaming; sixth, heating the shell to strengthen it; seventh, melting block shaped mixes of the composition and pouring into the shell; and finally, cooling and breaking the shell to get the finished casted item.

It is important to note that typical known cobalt chromium finger rings and tungsten carbide finger rings require high pressure high temperature processing for manufacture, similar to the manufacture of superabrasives, such as PCD or PCBN compacts for use in drill bits and other tools. Such manufacturing requires specialized equipment capable of providing high pressure and temperature for processing. Alloys in accordance with the present disclosure may not require these expensive specialized tools.

In one particular embodiment the hot investment casting includes, but is not limited to the following guidelines; machining a particular mould that will house a wax according to the required shape of the desired item to be formed from hardened cobalt based material. The mould can form any shape, but for a finger ring, the mould would typically be formed as a ring blank. For other items, the mould may have a different shape, corresponding to a rough shape of the item, or to a rod, tube, etc. as may be desired. This step may be known as a master die or master pattern. This mould, in most cases, may be manufactured from a low-melting-point metal or a steel alloy. It will be appreciated that once a "master mould" has been created it may be reused repeatedly for forming wax patterns.

A wax substance is then injected or poured into the machined mould to obtain the desired wax pattern. Where needed, a suitable release coating may be placed into the mould prior to wax injection. As formation of the wax pattern requires covering the entirety of the inner surface of the mould with the wax compound, turning or swishing the mould around may be required until an even coat is achieved. The wax may then be trimmed as need to form a surface that is smooth or without undesired excess edges. Next, the wax pattern must be assembled by removing it from the mould.

The desired pattern may be created and assembled into complex designs by attaching multiple wax patterns to a wax sprue, resulting in a wax cluster, or tree.

Investment may then be achieved by producing and repeating three unique steps: coating, stuccoing, and hardening. The first step, which may also be referred to as prime coating, is the process of placing the wax mould or wax cluster into a mixture of refractory materials and draining the excess to acquire a uniform coating. Once the uniform coating is achieved, the next step is stuccoing which involves adding more coarse ceramic particles by placing it into a fluidseed bed, rainfall-sander, or simply application by hand. Finally, sufficient time is allowed for the coating to harden. This process of investment may be repeated until a desired thickness is achieved. In practice, this may require from about 5 to about 10 repetitions of the process.

The investment may then be de-waxed by allowing it to dry completely, followed by placing it into a furnace and melting the wax causing a separation from the shell. In other embodiments, the shelled wax patterns may be placed into a dewaxing kettle and steamed to melt the wax leaving on the shell. For example, steam at about 100 degrees C. may be used.

After removal of the wax, the shell or mould may then be subjected to a burnout process, of heating the mould to harden and strengthen the material. For example, the shell may be heated in a furnace at about 900° C. to about 1100° C. for a period of up to 24 hours.

Next the original composition, which is the hardened cobalt based material described herein, may be melted and combined together in a furnace. This material may be melted by heating the combined powder mixture previously discussed herein. This includes the original material of cobalt, chromium and molybdenum with other elements, metals and materials. The investment mould is then placed upwards where the melted materials is gravity poured into the shell, which may take place through a runner system. Finally, the liquid is cooled, hammered to uncover the "rough" finished hardened item formed from the cobalt based composition which then may be cleaned by shot blast technology to remove the shell from the finished material.

Optional finishing steps may then take place, including various grinding, polishing processes or the like. In one illustrative process, an initial rough polishing may be performed to remove any debris and artifacts. The rough finished item may be shaped to refine contours by polishing and/or grinding (as by polishing with diamond or carbide finishing tools) to obtain desired inner and outer surface contours. Where the item is jewelry item, such as a finger ring, it may then be polished using very fine grain materials to produce a smooth finish. Typically, it is desirable to polish until there are no visible striations or marks on the surface with the unaided eye. For example, the outer surface can have a final polished finished with a surface roughness of between about 0.5 to about 0.1 microns. However, a matte or rustic finish may also be produced by leaving a greater surface roughness.

One advantage of the jewelry made in accordance with the principles of the present disclosure is that it may be easily removed in an emergency situation. A finger ring made of ASTM 15-37 cobalt chromium requires cutting with a ring saw for removal in an emergency situation. For example, if a wearer suffers an injury that produces swelling that prevents the ring from being slipped off the finger. If the injury is suffered in a remote location or a ring saw is not readily available, this can lead to further injury and complications. Further, retail jewelers have reported that many hospital locations do not have the capability or training to remove cobalt chromium or other strong rings, and resort to sending a patient to a nearby jewelry store in hopes that they have the capability to remove the ring, adding time and difficulty to treatment. By contrast, rings constructed from the alloys of the present disclosure, despite having increased tensile strength and reduced surface scratching compared to these known rings, can be removed by applying pressure to the outside annular surface of the ring with at least two points of pressure, overcoming the ring's ductility and causing the ring to crack into two or more pieces. This process is easily achieved by using common tools typically found in hospitals. This is an important advantage as an attempt to do so on a known cobalt chromium finger ring would merely bend the ring, which could result in further injury.

The ring cracking pressure required for breaking a ring for removal may be less than about 500 lbf in some embodiments, and may be less than about 475 lbf or about 450 lbf in other embodiments. This pressure can be applied by a ring cracking device, such as the commercially available Ring Cracker device for use by emergency rooms and medical personnel with tungsten rings. Additional devices may be used to apply the pressure as well, such as a readily available shop vise or clamps that may be present in an industrial setting or shop where an injury may occur.

Example 1

Analysis of Hardened Cobalt Alloy Materials Constructed in Accordance with the Present Disclosure A number of different hardened cobalt chromium alloy materials were considered for preparation from particulate powder blend of cobalt, the secondary metals chromium and molybdenum, the hardness enhancing metal silicon, and a combination of other binders including iron, carbon, nickel, and manganese. The amounts of materials to be used and the calculated hardness thereof are given in Table I, in reference to ASTM 15-37.

TABLE I

| | Alloy Types | | | | | | | | | |
|---|---|---|---|---|---|---|---|---|---|---|
| | Co wt % | Cr wt % | Mo wt % | C wt % | Ni wt % | Fe wt % | Mn wt % | Si wt % | Trace Elements | HRC |
| ASTM 15-37 | 63 | 28 | 6 | 0.2 | 1 | 1 | 0.5 | 0.2 | — | 28 |
| Material 1 | 36 | 35 | 20 | 0.5 | 2 | 4 | 0.5 | 2 | Al: 0.05 | 50 |
| Material 2 | 47 | 24 | 18 | 2.5 | 4 | 2 | 2.0 | 0.5 | B: 0.01 | 56 |
| Material 3 | 52.5 | 30 | 8 | 2 | 3 | 3 | 0.7 | 0.8 | Ca: 0.001 | 50 |
| Material 4 | 45.7 | 31 | 14 | 2 | 3 | 3 | 0.7 | 0.6 | Mg: 0.002 | 56 |
| Material 5 | Balance | 29 | 14 | | | | | 1 | 7 wt % AL | 60 |
| Material 6 | Balance | 18 | 28 | | | | | 3 | 2 wt % AL | 58 |
| Material 7 | Balance | 19 | 10 | | | | | 3 | 7 wt % B | 60 |

It is noted that Materials, 5, 6 and 7 additionally contain C, MN and other trace elements not shown in Table 1.

A prepared sample of material 4 was formed 4 by mixing of the base materials and melting and forming into a desired shape. A destructed analysis of the test sample was conducted. The analysis determined that formation of the material using methods in accordance this present disclosure resulted in a material that contained 1.95 wt % C, 0.51 wt % Si, 0.49 wt % Mn, <0.005 wt % P, 0.0023 wt % S, 30.01 wt % Cr, 2.96 wt % Ni, 13.86 wt %, Mo, 3.07 wt % Fe, with a balance of Cobalt. Density of the material was measured at 8.172 g/cm$^3$. Spectrometry was conducted to determine the release of nickel from the sample over time, and was determined to be less than 0.01 μg/cm$^2$/week.

Example 2

Comparison Compression Testing of Hardened Cobalt Alloy Rings to ASTM 15-37 Rings Six annular rings were prepared from Material 4 of Example 1. Six annular rings of equal size made of ASTM 15-37 material were obtained. All rings were compression tested on the same workstation under identical conditions. Compression testing was performed by compressing the rings with increasing force until failure or until a time of 1.0 minute had passed.

All rings prepared from material 4 exhibited failure and no ring prepared from ASTM material 15-37 exhibited failure. The test duration and peak load for each tested ring were as follows:

| Ring | Material | Test Duration | Peak Load |
|---|---|---|---|
| 1 | Material 4 | 00:00:05 | 463 lbf |
| 2 | Material 4 | 00:00:12 | 401 lbf |
| 3 | Material 4 | 00:00:14 | 311 lbf |
| 4 | Material 4 | 00:00:16 | 425 lbf |
| 5 | Material 4 | 00:00:13 | 428 lbf |
| 6 | Material 4 | 00:00:16 | 434 lbf |
| 1A | ASTM 15-37 | 00:01:01 | 747 lbf |
| 2A | ASTM 15-37 | 00:01:00 | 781 lbf |
| 3A | ASTM 15-37 | 00:01:00 | 725 lbf |
| 4A | ASTM 15-37 | 00:01:01 | 733 lbf |
| 5A | ASTM 15-37 | 00:01:00 | 689 lbf |
| 6A | ASTM 15-37 | 00:01:01 | 844 lbf |

These results demonstrate the ability of rings manufactured from the disclosed alloys to be removed by use of compression, as by a ring cracker.

While this invention has been described in certain embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

All references, including publications, patents, and patent applications, cited herein are hereby incorporated by reference to the same extent as if each reference were individually and specifically indicated to be incorporated by reference and were set forth in its entirety herein.

The invention claimed is:

1. A jewelry article configured to be broken in emergency situations, the jewelry article comprising:

an annular finger ring formed from a cobalt chromium alloy;

Wherein the cobalt chromium alloy comprises:

about 43 wt % to about 50 wt % cobalt;

about 27 wt % to about 32 wt % chromium;

about 12 wt % to about 16 wt % molybdenum;

at least one hardness enhancing element; and at least one binder;

wherein the cobalt chromium alloy has a surface hardness of at least 45 HRC; and wherein the annular finger ring is configured to break upon application of a force less than about 500 lbf to at least two points on the outside surface of the annular finger ring.

2. The jewelry article of claim 1, wherein the at least one hardness enhancing element is selected from aluminum, silicon, boron, titanium, iron, nickel, zirconium, cerium, lanthanum, carbon, manganese, and a combination of any of the foregoing.

3. The jewelry article of claim 1, wherein the at least one binder is selected from iron, carbon, nickel, manganese, and a combination of any of the foregoing.

4. The jewelry article of claim 1, wherein the cobalt chromium alloy has a density from about 4 g/cm$^3$ to about 11 g/cm$^3$.

5. The jewelry article of claim 1, wherein the cobalt chromium alloy has a density from about 7.5 g/cm$^3$ to about 9.5 g/cm$^3$.

6. The jewelry article of claim 1, wherein the surface hardness is at least 55 HRC.

7. The jewelry article of claim 1, wherein the surface hardness is from about 50 HRC to about 70 HRC.

8. The jewelry article of claim 1, wherein the cobalt chromium alloy comprises greater than about 90 wt % cobalt, chromium, and molybdenum combined.

9. The jewelry article of claim 1, wherein the force is from about 311 lbf to about 499 lbf.

10. The jewelry article of claim 1, wherein the cobalt chromium alloy comprises from about 0.5 wt % to about 10 wt % of the at least one hardness enhancing element.

11. The jewelry article of claim 1, wherein the hardness enhancing element comprises up to but not more than about 3 wt % each of carbon, nickel, and manganese.

12. The jewelry article of claim 1, wherein the at least one hardness enhancing element comprises up to but not more than about 6 wt % iron.

13. A jewelry article configured to be broken in emergency situations, the jewelry article comprising:

an annular finger ring formed from a cobalt chromium alloy;

wherein the cobalt chromium alloy comprises:

about 35 wt % to about 65 wt % cobalt;

about 16 wt % to about 20 wt % chromium;

about 26 wt % to about 31 wt % molybdenum;

at least one hardness enhancing element; and at least one binder;

wherein the cobalt chromium alloy has a surface hardness of at least 45 HRC; and wherein the annular finger ring is configured to break upon application of a force less than about 500 lbf to at least two points on the outside surface of the annular finger ring.

14. The jewelry article of claim 13, wherein the at least one hardness enhancing element is selected from aluminum, silicon, boron, titanium, iron, nickel, zirconium, cerium, lanthanum, carbon, manganese, and a combination of any of the foregoing.

15. The jewelry article of claim 13, wherein the at least one binder is selected from iron, carbon, nickel, manganese, and a combination of any of the foregoing.

16. The jewelry article of claim 13, wherein the cobalt chromium alloy has a density from about 4 g/cm$^3$ to about 11 g/cm$^3$.

17. The jewelry article of claim 13, wherein the cobalt chromium alloy has a density from about 7.5 g/cm$^3$ to about 9.5 g/cm$^3$.

18. The jewelry article of claim 13, wherein the surface hardness is at least 55 HRC.

19. The jewelry article of claim 13, wherein the surface hardness is from about 50 HRC to about 70 HRC.

20. The jewelry article of claim 13, wherein the cobalt chromium alloy comprises greater than about 90 wt % cobalt, chromium, and molybdenum combined.

21. The jewelry article of claim 13, wherein the force is from about 311 lbf to about 499 lbf.

22. The jewelry article of claim 13, wherein the cobalt chromium alloy comprises from about 0.5 wt % to about 10 wt % of the at least one hardness enhancing element.

23. The jewelry article of claim 13, wherein the hardness enhancing element comprises up to but not more than about 3 wt % each of carbon, nickel, and manganese.

24. The jewelry article of claim 13, wherein the at least one hardness enhancing element comprises up to but not more than about 6 wt % iron.

25. A jewelry article configured to be broken in emergency situations, the jewelry article comprising:

an annular finger ring formed from a cobalt chromium alloy;

wherein the cobalt chromium alloy comprises:

about 35 wt % to about 65 wt % cobalt;

about 17 wt % to about 21 wt % chromium;

about 8 wt % to about 12 wt % molybdenum;

at least one hardness enhancing element; and at least one binder;

wherein the cobalt chromium alloy has a surface hardness of at least 45 HRC; and wherein the annular finger ring is configured to break upon application of a force less than about 500 lbf to at least two points on the outside surface of the annular finger ring.

26. The jewelry article of claim 25, wherein the at least one hardness enhancing element is selected from aluminum, silicon, boron, titanium, iron, nickel, zirconium, cerium, lanthanum, carbon, manganese, and a combination of any of the foregoing.

27. The jewelry article of claim 25, wherein the at least one binder is selected from iron, carbon, nickel, manganese, and a combination of any of the foregoing.

28. The jewelry article of claim 25, wherein the cobalt chromium alloy has a density from about 4 g/cm$^3$ to about 11 g/cm$^3$.

29. The jewelry article of claim 25, wherein the cobalt chromium alloy has a density from about 7.5 g/cm$^3$ to about 9.5 g/cm$^3$.

30. The jewelry article of claim 25, wherein the surface hardness is at least 55 HRC.

31. The jewelry article of claim 25, wherein the surface hardness is from about 50 HRC to about 70 HRC.

32. The jewelry article of claim 25, wherein the cobalt chromium alloy comprises greater than about 90 wt % cobalt, chromium, and molybdenum combined.

33. The jewelry article of claim 25, wherein the force is from about 311 lbf to about 499 lbf.

34. The jewelry article of claim 25, wherein the cobalt chromium alloy comprises from about 0.5 wt % to about 10 wt % of the at least one hardness enhancing element.

35. The jewelry article of claim 25, wherein the hardness enhancing element comprises up to but not more than about 3 wt % each of carbon, nickel, and manganese.

36. The jewelry article of claim 25, wherein the at least one hardness enhancing element comprises up to but not more than about 6 wt % iron.

* * * * *